United States Patent [19]

Fier

[11] 4,097,171

[45] Jun. 27, 1978

[54] MANHOLE COVER SUPPORT RING

[76] Inventor: Raymond L. Fier, 5323 Pin Oak Ave. NW., Massillon, Stark County, Ohio 44646

[21] Appl. No.: 833,805

[22] Filed: Sep. 16, 1977

[51] Int. Cl.[2] ..... E02D 29/14

[52] U.S. Cl. ..... 404/26; 210/163; 52/20

[58] Field of Search ..... 404/25, 26; 210/163, 210/164; 52/20

[56] References Cited

U.S. PATENT DOCUMENTS

| | | | |
|---|---|---|---|
| 1,517,871 | 12/1924 | Thompson | 404/26 |
| 2,346,361 | 4/1944 | Cupido | 404/25 X |
| 3,218,943 | 11/1965 | Bowman | 404/26 |
| 3,773,428 | 11/1973 | Bowman | 404/26 |
| 3,891,337 | 6/1975 | McCoy | 404/26 |

FOREIGN PATENT DOCUMENTS

| | | | |
|---|---|---|---|
| 394,687 | 12/1965 | Switzerland | 404/25 |

*Primary Examiner*—Nile C. Byers
*Attorney, Agent, or Firm*—Frease & Bishop

[57] ABSTRACT

A manhole cover support ring adapted to be placed within an existing manhole frame for raising the height of a manhole cover. A circular ring is formed by a generally vertically extending flange having an annular bar welded on its lower end which provides an inwardly extending manhole cover support ledge. The flange and bar are split at a common point on their peripheries. A toggle mechanism is pivotally mounted on at least one of the spaced ends of the bar and is operatively engageable with the other bar end. Actuation of the toggle mechanism to an over center position expands the ring flange into abutting relationship with a complementary circular portion of the manhole frame which forms the manhole opening to secure the support ring on the manhole frame. The toggle mechanism includes a pivotally mounted bolt which is threadably engaged with a portion of one of the toggle levers for adjusting the outward expansion limit of the ring.

20 Claims, 11 Drawing Figures

MANHOLE COVER SUPPORT RING

BACKGROUND OF THE INVENTION

1. Field of the Invention

The invention relates to manhole cover supports and in particular to a separate ring placed within an existing manhole to raise the height of the manhole cover to compensate for added roadway pavement. More particularly the invention relates to a manhole cover support ring mounted within an existing manhole frame opening by a toggle mechanism which expands the ring outwardly into clamping engagement with the manhole cover frame.

2. Description of the Prior Art

Most underground facilities such as sanitary and storm sewers, utility conduits and the like have manhole openings to provide access thereto. These manholes usually are located in the street or roadway and consist of an inverted bell-shaped metal frame mounted on top of a brick or concrete base structure. This metal frame has an internal ledge for supporting the manhole cover so that the top of the cover is level with the top of the frame and surrounding roadway pavement.

Problems arise quite frequently in the resurfacing of roadways in that a layer of pavement is placed on the existing pavement resulting in the manhole cover being below the top surface of the new pavement causing a depression in the roadway. It is quite difficult and expensive to raise the existing manhole frame sufficiently to compensate for the added pavement.

Various devices have been constructed which enable an existing manhole cover to be raised to the level of the new pavement surface without raising the existing manhole frame. Examples of these devices are shown in U.S. Pat. Nos. 1,517,871, 3,218,943, 3,773,428, and 3,891,337.

Some of these prior art devices, although apparently providing the desired results, are expensive to manufacture due to the number of machining and forming operations required for their fabrication. Likewise, these devices achieve their adjustment and/or clamping engagement with the manhole frame by a threaded screw mechanism which in time may become loose due the continuous vibration caused by passing vehicles. These screw mechanisms become corroded preventing removal of the elevating ring should their removal be required in the future. Most known devices use an expanding mechanism which protrudes into the I.D. of the manhole, thereby reducing the actual I.D. as well as creating a work and safety hazard for workmen climbing into and out of the manhole opening.

No manhole cover support ring of which I am aware uses an internal peripherally mounted toggle mechanism for expanding the support ring outwardly into clamping engagement with the edges of the manhole frame concentric to the manhole opening.

SUMMARY OF THE INVENTION

Objectives of the invention include providing a manhole cover support ring formed relatively inexpensively of a flat strip of metal and a strip of rectangular bar stock which is welded on the lower end of the strip, both of which then are formed into a circular configuration with a gap existing between the adjacent spaced ends, and in which a toggle mechanism is mounted on and operatively engageable with the spaced end portions of the ring to forcibly expand the ring outwardly into engagement with the sides of an existing manhole opening frame; providing such a support ring in which the toggle mechanism is moved from open to closed position by a single blow of a hammer when installing the ring in an existing manhole, and in which the support ring can be moved from closed to open position by use of a screwdriver or other level bar which snaps the mechanism past center for removing the support ring; providing such a support ring in which the toggle mechanism is easily adjusted to regulate the limits of outward expansion of the ring so as to compensate for and accommodate minor variations in manhole opening sizes and irregularities of roundness; providing such a support ring which is less susceptible to loosening due to vibrations of passing vehicles than most known prior devices, and in which the amount of vertical height adjustment of the cover can be varied easily by changing the size of either the flat metal strip or bar components; providing such a support ring in which the expansion mechanism lies within the periphery of the ring without any components protruding into the I.D. of the manhole opening thereby eliminating a work hazard and maintaining the effective I.D. of the manhole opening; and providing a manhole cover supporting ring which is relatively inexpensive, which eliminates difficulties heretofore encountered with prior devices, achieves the stated objectives simply, effectively and efficiently, and solves problems and satisfies existing needs.

These objectives and advantages are obtained by the ring construction for supporting a manhole cover in an elevated position within a manhole frame, the general nature of said ring construction may be stated as including circular ring means having inwardly projecting manhole cover supporting ledge means and upwardly extending flange means, the ring means being split at least at one point on its periphery forming a pair of spaced end portions; toggle means mounted on the ring means and extending between and operatively engageable with the spaced end portions for expanding the ring means outwardly to force the flange means into abutting engagement with a manhole frame; the ring means including a generally vertically extending flange and a bar mounted on the lower end of the flange and projecting inwardly therefrom to form the cover supporting ledge means; the toggle means including a pair of levers each having first and second ends, said first ends being operatively engageable with a respective spaced end portion of the ring means, and the second ends being operatively engaged with each other and movable generally radially between open and closed positions.

BRIEF DESCRIPTION OF THE DRAWINGS

Preferred embodiments of the invention — illustrative of the best modes in which applicant has contemplated applying the principles — are set forth in the following description and shown in the drawings and are particularly and distinctly pointed out and set forth in the appended claims.

Similar numerals refer to similar parts throughout the drawings.

DESCRIPTION OF THE PREFERRED EMBODIMENTS

First Embodiment

Figure 1:
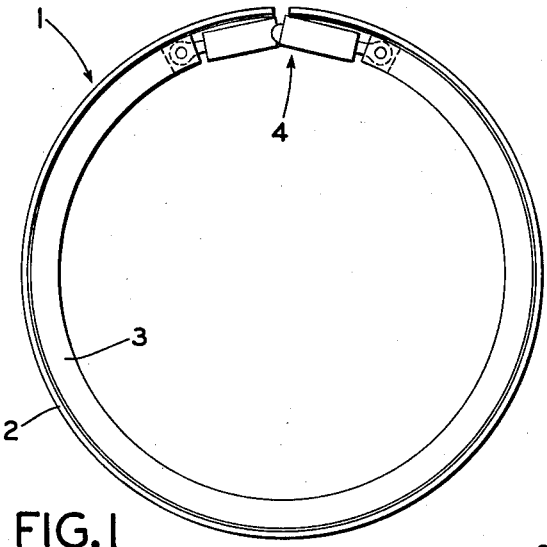
FIG. 1 is a top plan view of the improved manhole cover support ring.
Figure 6:
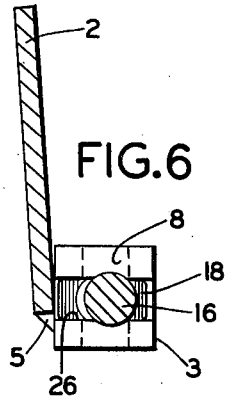
FIG. 6 is a sectional view taken on line 6—6, FIG. 3.
Figure 5:
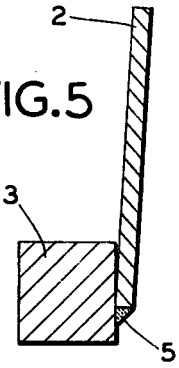
FIG. 5 is a sectional view taken on line 5—5, FIG. 3.

The improved manhole cover support ring is indicated generally at 1 and is shown in FIG. 1. Ring 1 includes as its main components a generally vertical flange 2, a lower manhole cover support bar 3 and a toggle mechanism, indicated generally at 4. Flange 2 is formed of a relatively flat metal strip, with bar 3 being formed from bar stock preferably having a rectangular cross-sectional configuration. Bar 3 is attched by welds 5 to the bottom portion of flange 2 (FIG. 5). Flange 2 and bar 3 are formed into a circular configuration before or after being welded together as shown in FIG. 1, with bar 3 lying inwardly or inside of the periphery of flange 2.

Figure 2:
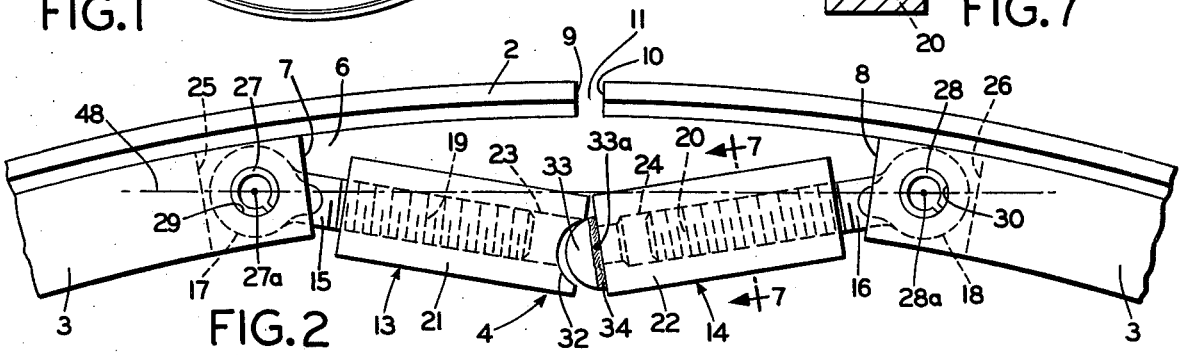
FIG. 2 is an enlarged fragmentary top plan view of the toggle mechanism shown in open position of the improved support ring of FIG. 1.
Figure 3:
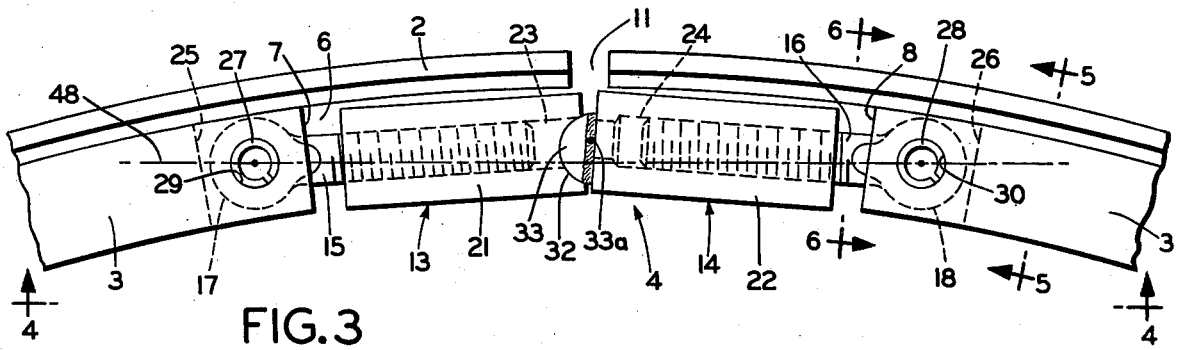
FIG. 3 is a top plan fragmentary view similar to FIG. 2 showing the toggle mechanism in closed position.

The length of bar 3 is shorter than that of flange 2. This arrangement provides a greater separation or gap 6 between spaced ends 7 and 8 of bar 3 than the separation or gap 11 between spaced ends 9 and 10 of flange 2 when flange 2 and bar 3 are formed into their circular configuration. Enlarged gap 6 provides sufficient space for mounting of toggle mechanism 4 as shown in FIGS. 2 and 3, and still provide support for a manhole cover by means of toggle mechanism 4.

Manhole frames used by most cities and municipalities have a predetermined size opening so that the required diameter size of ring 2 is known at time of construction. In the event the particular manhole opening in which ring 1 is to be used varies from a standard size, the diameter of ring 1 can be changed accordingly by varying the lengths of flange 2 and bar 3. Flange 2, when assembled with bar 3 preferably extends slightly outwardly from a true vertical position, as shown in FIG. 5, and forms a frusto conical configuration.

Figure 7:
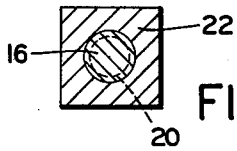
FIG. 7 is a sectional view taken on line 7—7, FIG. 2.

In accordance with one of the main features of the invention, toggle mechanism 4 is mounted on bar 3 and extends across gap 6 between the spaced ends 7 and 8. Mechanism 4 (FIGS. 2, 3 and 4) includes a pair of levers, indicated generally at 13 and 14. Levers 13 and 14 consist of threaded rods 15 and 16, one end of which are formed with eyelets 17 and 18 with the other ends having threads 19 and 20 formed therealong, respectively. Sleeves 21 and 22 are adjustably mounted on the swinging ends of rods 15 and 16 by engagement of rod threads 19 and 20 with threaded bores 23 and 24 formed in sleeves 21 and 22, respectively. Sleeves 21 and 22 preferably have rectangular or square cross-sectional configurations, as shown in FIG. 7, and may be formed from a bar stock similar to bar 3.

Levers 13 and 14 are pivotally mounted on the spaced ends 7 and 8 of bar 3 by placement of eyelets 17 and 18 within slots 25 and 26 formed therein. Slit sleeves or roll pins 27 and 28 extend through holes 29 and 30 formed in bar ends 7 and 8, respectively, and through eyelets 17 and 18 to form the pivot pins.

Levers 13 and 14 are adapted to swing in a generally radial direction with respect to the center point of ring 1 between the open position of FIG. 2 and the closed position of FIG. 3. The outer end of lever 13 is formed with a concave recess 32 with a half round projection 33 being formed on the other end of lever 14. Projection 33 has a smooth curved convex configuration complementary to concave recess 32 of lever 13. Convex projection 33 may be a half portion of round bar stock which is cut to the desired length and secured by a weld 34 to the outer end of lever 14, or may be a single burned out piece or machined convex projection.

Figure 11:
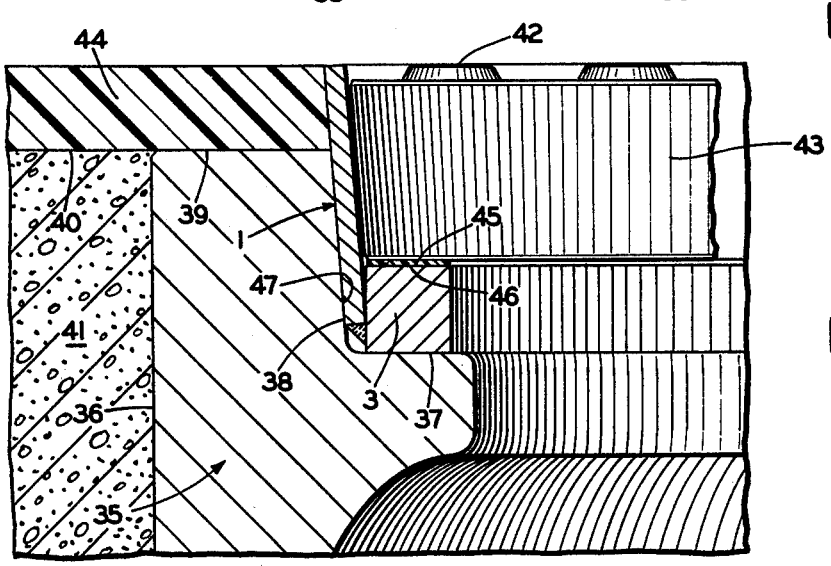
FIG. 11 is an enlarged fragmentary sectional view of the improved manhole cover support ring mounted on an existing manhole frame.

FIG. 11 shows a portion of improved support ring 1 mounted within a usual manhole opening 47. A usual manhole consists of an annular frame 35 (only a portion of the top being shown in FIG. 11) which has a cylindrical outer surface 36 and an annular horizontal manhole cover supporting ledge 37. Ledge 37 terminates in an upwardly outwardly extending conical wall 38 which is connected with outer surface 36 by an annular horizontal top surface 39. The top surface 40 of the original roadway pavement 41 is level with top surface 39 of manhole frame 35, which also will be level with the top surface 42 of a manhole cover 43 when cover 43 is supported on horizontal ledge 37.

Ring 1 is shown placed in clamped position on manhole frame 35 (FIG. 11) with a new layer of pavement 44 being shown placed on original pavement 41. Bar 3 rests upon and is supported by manhole frame ledge 37 with flange 3 being in clamped contact with conical wall 38 of manhole frame 35. A rubber or synthetic annular gasket 45 is placed on top surface 46 of bar 3 to dampen vibration and reduce chatter before placement of manhole cover 43 on ring 1. The vertical height of bar 3 generally will be equal to the thickness of new pavement layer 44 so as to raise the manhole cover this amount vertically above existing manhole frame ledge 37, as shown in FIG. 11.

When installing ring 1, all dirt, rust and debris is removed from ledge 37 and conical wall 38 of manhole frame 35. Ring 1 is placed within manhole opening 47 which is defined by frame wall 38, with toggle mechanism 4 being in the open position of FIG. 2. Levers 13 and 14 are forcibly struck at their junction in an outwardly radial direction which pivots the levers radially outwardly on split sleeves 27 and 28 about imaginary pivot points 27*a* and 28*a* to the closed position of FIG. 3. Convex projection 33 will slidably pivot within concave recess 32 of lever 13 when levers 13 and 14 swing between open and closed positions, which movement will expand flange 2 radially outwardly into engagement with conical wall 38 of manhole frame 35. An imaginary pivot point 33*a* at the end of lever 14 adjacent the junction with lever 13 will move across an imaginary centerline 48 which extends between pivot points 27*a* and 28*a* of sleeves 27 and 28.

In the event a sufficiently tight clamping fit is not achieved, toggle mechanism 4 is moved to the open position of FIG. 2 by a simple prying action of a screwdriver or lever to move the swinging ends of levers 13 and 14 radially inwardly beyond centerline 48. Either sleeves 21 or 22, or both, then are adjusted by rotation on rods 15 and 16. After adjustment the levers are placed in the position of FIG. 2 and restruck with a hammer, whereupon the lever swinging ends move radially outwardly to the closed position of FIG. 3. Sleeves 21 or 22 will contact flange 2 to limit their movement beyond centerline 48, as shown in FIG. 3, to prevent loosening of expanded flange 2.

After the desired clamping engagement is achieved between flange 2 and conical frame wall 38, gasket 45 is placed on top surface 46 of bar 3 and manhole cover 43 is placed thereon in a usual manner with its top surface 42 now being level with the top surface of new pavement layer 44 (FIG. 11). If desired, gasket 45 may be bonded to top surface 46 of bar 3 and to the top surfaces of lever sleeves 21 and 22 during fabrication.

Second Embodiment

Figure 8:
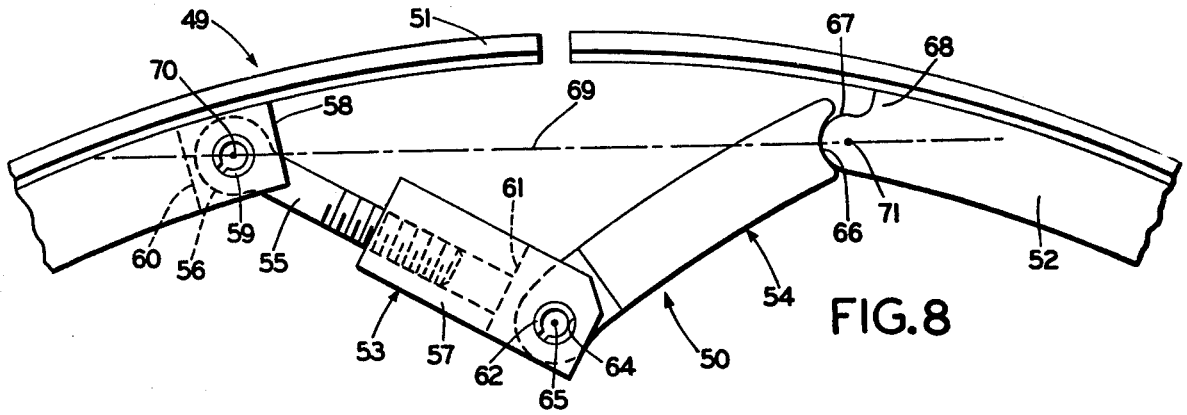
FIG. 8 is a fragmentary top plan view similar to FIG. 2 showing another type of toggle mechanism (in open position) for use with the support ring of FIG. 1.
Figure 9:
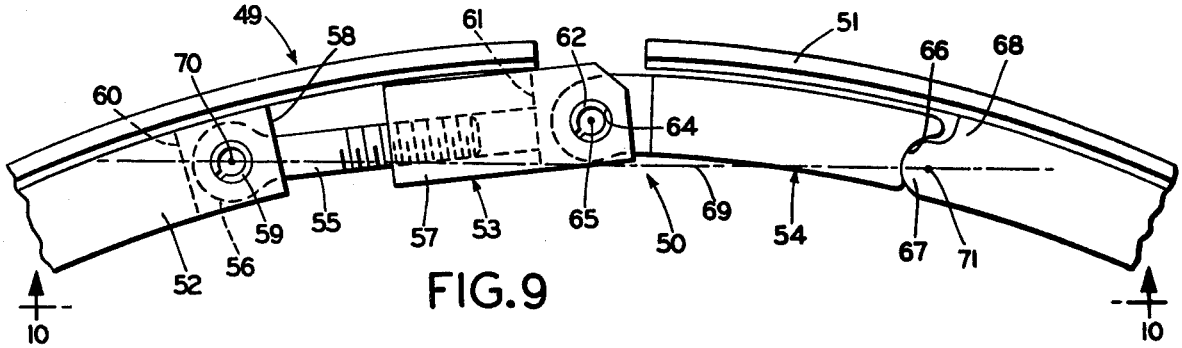
FIG. 9 is a fragmentary top plan view similar to FIG. 8 showing the toggle mechanism in closed position.
Figure 10:
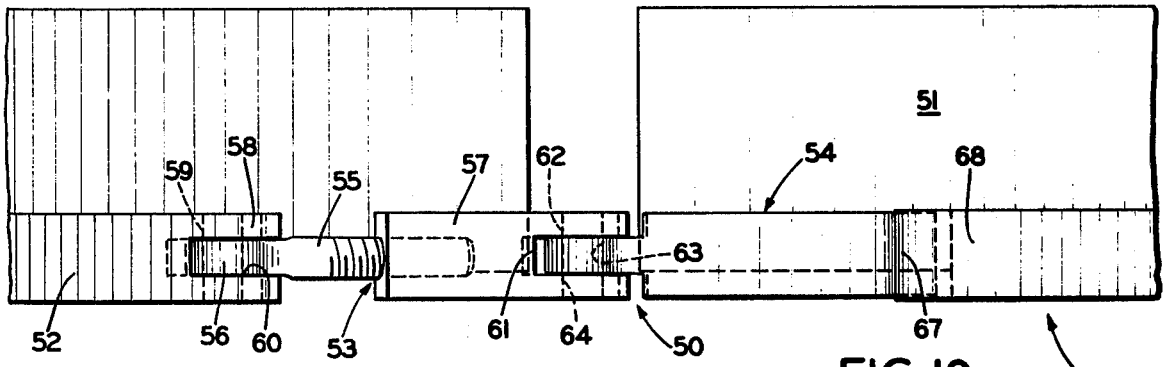
FIG. 10 is an elevational view looking in the direction of arrows 10—10, FIG. 9.

A modified form of the invention is shown in FIGS. 8, 9 and 10 and is indicated generally at 49. The main feature of this second embodiment is a modified toggle mechanism indicated generally at 50. Modified ring 49 includes a generally vertical flange 51 and a manhole cover support bar 52 which are similar to flange 2 and bar 3 of support ring 1.

Toggle mechanism 50 includes a pair of levers 53 and 54 with lever 53 being similar to levers 13 and 14 of toggle mechanism 4. Lever 53 includes a threaded rod 55 having an eyelet 56 at one end and an adjusting sleeve 57 at its other end. Lever 53 is pivotally mounted on end 58 of bar 52 by a split sleeve or roll pin 59 as are levers 13 and 14. Eyelet 56 is located within a slot 60 formed in bar end 58 (FIG. 10).

The outer end of adjusting sleeve 57 is formed with a slot 61 for pivotally mounting lever 54 therein by a split sleeve 62. Sleeve 62 extends through an opening 63 formed in the end of lever 54 and through a pair of aligned holes 64 formed in the end of lever sleeve 57. The free or swinging end of lever 54 is formed with a concave recess 66 which slidably pivots about a generally complementary convex projection 67 formed on end 68 of bar 52.

The operation of toggle mechanism 50 is similar to that of mechanism 4, discussed above. An imaginary pivot point 65 formed at the pivotal connection of levers 53 and 54, moves across an imaginary centerline 69 when moving between the open and closed positions of FIGS. 8 and 9. Centerline 69 extends between imaginary points 70 and 71, in which point 71 is the imaginary point about which concave surface 66 slidably pivots when contacting convex projecting surface 67.

SUMMARY

Support ring constructions 1 and 49 may have a rectangular shape if desired in which a pair of toggle mechanisms 4 or 50 are located at a pair of split locations on opposite sides of the rectangular frame. The rectangular frame would be formed of a vertical flange and cover supporting bar similar to flanges 2 and 51 and bars 3 and 52, described above and shown in the drawings. However, since most manhole frames and the openings formed thereby are circular, the two embodiments shown will be the usual construction used for most applications.

Likewise, toggle mechanisms 4 and 50 could consist of a pair of levers similar to lever 54. Each lever would have a concave surface formed on one end which is adapted to engage convex projections formed on the spaced ends of a split ring. The two levers would be pivotally joined at a common end similar to toggle mechanism 50, as shown in FIGS. 8 and 9. This toggle mechanism would be a separate component and not attached to the manhole support ring. Also, if desired, one of the levers of this mechanism could have an adjustable sleeve similar to that of levers 21 and 22 of FIGS. 2 and 3.

Since pins 27, 28, 59 and 62 are of a split sleeve configuration, they provide a very slight amount of compression thereto. This compression reduces the amount of inward movement of the ring which occurs after the toggle levers move beyond center to maintain a tight clamping action between the ring flange and the vertical surface of the manhole frame.

Another of the important features of ring constructions 1 and 49 is the location of toggle mechanisms 4 and 50 completely within the periphery of the rings when in closed position, as shown in FIGS. 3 and 9. This arrangement maintains the effective I.D. of the support rings and eliminates any hazardous protusions into the manhole opening as present in some prior art constructions. When rings 1 and 49 are installed in an existing manhole, as shown in FIG. 11, the existing I.D. of the manhole opening is unchanged.

Figure 4:
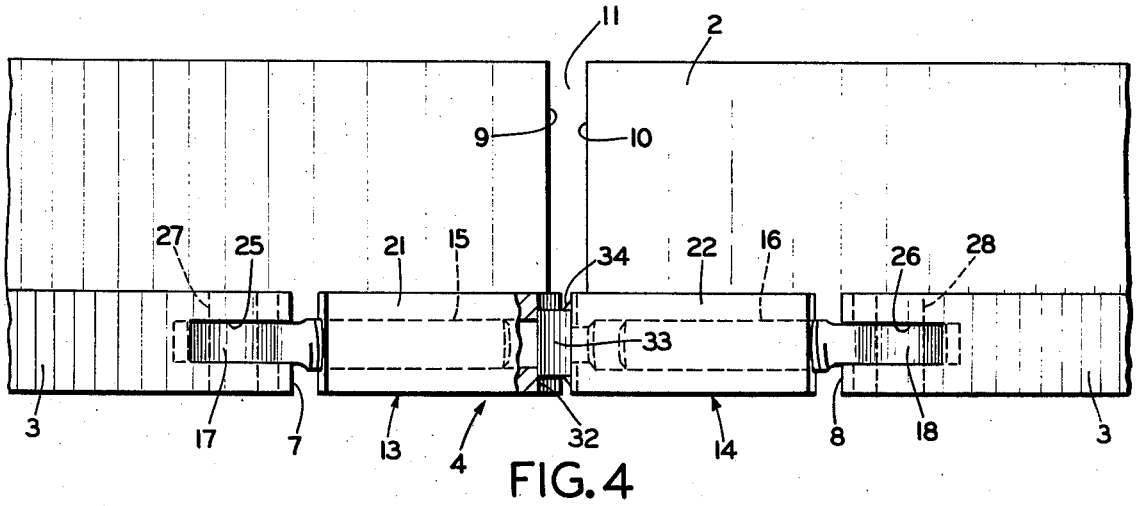
FIG. 4 is an elevational view of the toggle mechanism looking in the direction of arrows 4—4, FIG. 3.

Lever sleeves 21, 22, 57 and lever 54 preferably are formed of a bar stock similar to that of bars 3 and 52, whereby their top surfaces lie in the same horizontal plane as the top surfaces of bars 3 and 52, as shown in FIGS. 4 and 10. This arrangement provides a nearly continuous support for manhole cover 43 even across the gaps formed by the spaced ends of bars 3 and 52.

Several types of existing manhole frames have a semicircular inwardly projecting member which will interfere with any support ring placed thereon. This problem is eliminated easily by regulating the gap between the spaced ends of flange 51 to permit the frame projection to extend therein. A concave recess or indentation is formed in lever 54 which is complementary to the manhole frame projection. The principle of operation and construction of such a modified support ring is the same as that of ring construction 49, and therefore, is not shown in detail.

Accordingly, the improved manhole support ring provides a construction which is formed of a few relatively inexpensive and readily available components which are assembled by a usual welding procedure; provides such a construction using a toggle mechanism for expanding the ring outwardly into secure clamping engagement with an existing manhole frame without reducing the effective I.D. of the manhole opening; and provides a construction which is simplified, effective and safe in operation; which eliminates difficulties existing in the art, and which achieves the stated objectives and solves problems that have existed in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the manhole cover support ring is constructed and used, the characteristics of the construction, and the advantageous, new and useful results obtained; the new and useful structures, devices, elements, arrangements, parts and combinations, are set forth in the appended claims.

I claim:

1. Ring construction for supporting a manhole cover in an elevated position within a manhole frame including:

a. circular ring means having inwardly projecting manhole cover supporting ledge means and upwardly extending flange means, said ring means being split at least at one point on its periphery forming a pair of spaced end portions; and b. toggle means mounted on the ring means and extending between and operatively engageable with the spaced end portions for expanding the ring means outwardly to force the flange means into abutting engagement with the manhole frame.

2. The construction defined in claim 1 in which the ring means includes a generally vertically extending flange and a bar; and in which the bar is mounted on the lower end of the flange and projects inwardly therefrom to form the cover supporting ledge means.

3. The construction defined in claim 2 in which the bar has a rectangular cross-sectional configuration and is welded to the vertical flange.

4. The construction defined in claim 2 in which the toggle means is mounted on the bar of the ring means.

5. The construction defined in claim 1 in which the toggle means includes a pair of levers each having first and second ends; in which the first ends are operatively engageable with a respective spaced end portion of the ring means; and in which the second ends are operatively engaged with each other and movable generally radially between open and closed positions.

6. The construction defined in claim 5 in which each of the levers includes a threaded rod pivotally mounted at one end on a respective end portion of the ring means and a sleeve threadably engaged with the other end of the rod; and in which the sleeves are slidably abuttingly engaged with each other.

7. The construction defined in claim 6 in which one of the sleeves is formed with a rounded convex end surface; and in which the other sleeve is formed with a rounded concave end surface complementary to the rounded convex surface of said one sleeve for sliding engagement therewith.

8. The construction defined in claim 5 in which the first end of one of the levers is pivotally mounted on the ring means; in which the second ends of the levers are pivotally joined to each other; and in which the first end of the other lever is slidably movably engaged with the ring means.

9. The construction defined in claim 8 in which said one lever includes a threaded rod and a sleeve adjustably mounted on said rod; in which projection means is formed on the ring means and has a rounded convex surface; in which the first end of said other lever has a rounded concave surface; and in which said concave surface is slidably engageable with the convex surface of the ring means projection.

10. The construction defined in claim 5 in which the levers lie within the periphery of the ring means when the toggle means is in closed position.

11. The construction defined in claim 6 in which the sleeves have rectangular cross-sectional configurations and are formed with internal threaded bores; and in which the rods are threadably engaged with said bores.

12. A manhole assembly including:

a. a manhole frame adapted to be placed below a pavement surface, said frame having a generally vertically extending inner conical surface defining a manhole opening, and an annular horizontal surface extending inwardly from said conical surface;

b. ring means having a generally vertically extending conical flange and an annular ledge mounted on the bottom of said conical flange and extending inwardly therefrom, said flange and ledge being split at a common point on their periphery forming a gap between spaced ends of said flange and ledge;

c. lever means pivotally mounted on the ring means and extending between and operatively engageable with the spaced ends of the ledge for expanding the ring means outwardly upon movement of the lever means from an open position to a closed position;

d. the ring means being supported on the horizontal surface of the manhole frame, with the ring means flange being in abutting engagement with the conical surface of said manhole frame when the lever means is in closed position; and e. a circular manhole cover lying within the conical flange of the ring means and being supported on the ledge of the ring means, vertically raising the cover above the horizontal surface of the manhole frame.

13. The assembly defined in claim 12 in which annular gasket means is mounted on the ring means ledge beneath the manhole cover to damper vibration.

14. The assembly defined in claim 12 in which the lever means includes a pair of levers, each lever having first and second ends; in which the lever second ends are operatively engageable with a respective spaced end of the ring means ledge; and in which the lever first ends are operatively engageable with each other, whereby outward movement of the mutually engaged lever first ends expands the ring means outwardly by movement of the lever second ends against the spaced ends of the ledge.

15. The assembly defined in claim 14 in which at least one of the lever second ends is pivotally mounted on a spaced end of the ring means ledge.

16. The assembly defined in claim 14 in which pin means pivotally connect together the lever first ends.

17. The assembly defined in claim 12 in which the length of at least one of the lever means is adjustable.

18. A device for vertically elevating a manhole cover with respect to an existing manhole frame including:

a. frame means having generally vertical flange means and horizontal ledge means projecting inwardly from the bottom of said flange means, said frame means being split at least at one point on its periphery forming a pair of spaced ends;

b. toggle means acting between the spaced ends of the frame means to expand the frame means outwardly, with the flange means buttingly engaging the existing manhole frame; and c. the ledge means being adapted to support a manhole cover placed thereon in an elevated position with respect to the manhole frame.

19. The device defined in claim 18 in which the frame means has a circular configuration; and in which the toggle means lies within the periphery of said circular frame means.

20. The device defined in claim 19 in which the toggle means includes a pair of levers, each having a pair of ends; and in which one end of each lever are operatively engageable with each other, with the other ends of the levers being operatively engageable with a respective spaced end of the frame means.

* * * * *